US005655559A

United States Patent [19]

Zembik et al.

[11] Patent Number: 5,655,559

[45] Date of Patent: Aug. 12, 1997

[54] SHELTER

[75] Inventors: Allen J. Zembik, Box 57, Prince Albert SK, Canada, S6V 5R4; Ronald R. Lefebvre, Saskatoon; Glen Lefebvre, St. Brieux, both of Canada

[73] Assignee: Allen J. Zembik, Prince Albert, Canada

[21] Appl. No.: 406,966

[22] PCT Filed: Nov. 16, 1994

[86] PCT No.: PCT/CA94/00622

§ 371 Date: Mar. 28, 1995

§ 102(e) Date: Mar. 28, 1995

[87] PCT Pub. No.: WO95/14840

PCT Pub. Date: Jun. 1, 1995

[51] Int. Cl.[6] ..... E04H 15/38

[52] U.S. Cl. ..... 135/132; 135/133; 135/906; 135/147; 135/135

[58] Field of Search ..... 403/112, 113, 403/65; 135/132, 133, 135, 147, 148, 149, 151, 900, 901, 906

[56] References Cited

U.S. PATENT DOCUMENTS

| | | | |
|---|---|---|---|
| 2,598,940 | 6/1952 | Robie . | |
| 3,906,968 | 9/1975 | Black . | |
| 3,995,649 | 12/1976 | Robichaud | 135/133 |
| 4,084,599 | 4/1978 | Matthews | 135/132 |
| 4,227,542 | 10/1980 | Bonfilio | 135/906 X |
| 4,239,247 | 12/1980 | Hinz . | |
| 4,271,856 | 6/1981 | Ferguson . | |
| 4,343,322 | 8/1982 | Fiddler | 135/133 X |
| 4,425,929 | 1/1984 | Von Mosshaim . | |
| 5,004,001 | 4/1991 | Bouchard | 135/133 X |
| 5,085,240 | 2/1992 | Littledeer . | |
| 5,159,947 | 11/1992 | Chuang et al. . | |
| 5,184,865 | 2/1993 | Mohtasham et al. | 135/133 X |

FOREIGN PATENT DOCUMENTS

| | | |
|---|---|---|
| 574681 | 4/1958 | Canada . |
| 575138 | 5/1959 | Canada . |
| 1009536 | 5/1977 | Canada . |
| 1129754 | 8/1982 | Canada . |
| 0364646 | 4/1990 | European Pat. Off. . |
| WO80/02637 | 12/1980 | WIPO . |

*Primary Examiner*—Wynn E. Wood

*Attorney, Agent, or Firm*—Murray E. Thrift; Adrian D. Battison

[57] ABSTRACT

A shelter has two hinge assemblies on opposite sides and a series of hoops radiating from the hinge assemblies to support a canopy. The shelter may be opened from either end. Each hinge assembly includes two arms that support respective halves of the support hoops. The arms pivot about a lateral pivot axis so that when the shelter is opened, one of the arms will pivot upwardly so that the hoops carried by it will lie flat on top of the hoops attached to the other hinge arm.

14 Claims, 5 Drawing Sheets

SHELTER

FIELD OF THE INVENTION

The present invention relates to shelters and more particularly to lightweight, multipurpose shelters and hardware for use in the shelters.

BACKGROUND

Lightweight shelters have been constructed in the past using sets of hoops radiating from a central position on each side of the shelter to support a canopy. The hoops may be mounted on hinges at the centre so that the shelter may be opened by lifting one end. One difficulty with a shelter of this sort is the base on which the hoops are mounted. While it has been proposed to use base hinges so that the hoops can pivot for opening and closing the shelter, the prior art hinges provide only limited movement because of interference of the hoops with one another. In some cases, this can be dealt with by making the hoops of different sizes to nest together, but this requires several different sizes of hoops. Manufacturing costs and complexity of assembly are consequently inceased.

The present invention proposes a hinge construction and a shelter that mitigate these problems.

SUMMARY

According to one aspect of the present invention there is provided a hinge for connecting a plurality of members for movement between extended condition with the members radiating at spaced positions along an arc of substantially 180°, and a collapsed condition with the members stacked adjacent the hinge, said hinge comprising:

a base;

two hinge arms;

arm pivot means mounting each of the hinge arms on the base for pivotal movement about a lateral hinge arm axis;

means for pivotally mounting the members on the hinge arms at spaced locations therealong, for pivotal movement of the members about respective lateral member axes with respect to the associated hinge arms.

The hinge arms may be pivoted so that the arms project in opposite directions from the arm pivot in the collapsed condition. Consequently the members will be connected to the arms in a spaced, row so that they may lie flat on one another.

According to another aspect of the invention there is provided a shelter having two laterally spaced sides and two longitudinally spaced ends, the shelter comprising two laterally spaced apart hinge assemblies; a plurality of laterally extending hoops coupled to the hinge assemblies for movement between an extended condition of the shelter with the hoops radiating from the hinge assemblies at positions spaced angularly through an arc of approximately 180° about the hinge assemblies, and a collapsed condition with the hoops stacked to one end of the hinge assemblies, and a canopy connected to the hoops to be supported thereby in the extended condition of the shelter, wherein each hinge assembly comprises:

a base;

first and second hinge arms, each mounted on the base for pivotal movement about a lateral arm axis, each hinge arm being pivotable between a closed position extending downwardly from the lateral arm axis and an open position projecting upwardly from the lateral arm axis, each hoop being pivotally mounted on a respective hinge arm of each hinge assembly for pivotal movement about a respective lateral hoop axis.

A shelter constructed this way may opened fully from either end. It may be constructed as a dome with curved hoops, or in a more rectangular shape with hoops having distinct side and top sections. The shelters may be used in many ways, for example as greenhouses; garages for automobiles, trucks, snowmobiles or all terrain vehicles; construction shelters; gazebos; tents; garden shelters; ice fishing huts; and hunting blinds.

The nature of the canopy will vary according to use. It may be a weatherproof tarpaulin material, a transparent film or screening. Where desired, windows or other openings may be provided in the canopy.

BRIEF DESCRIPTION OF THE INVENTION

In the accompanying drawings, which illustrate exemplary embodiments of the present invention:

DETAILED DESCRIPTION

Figure 1:
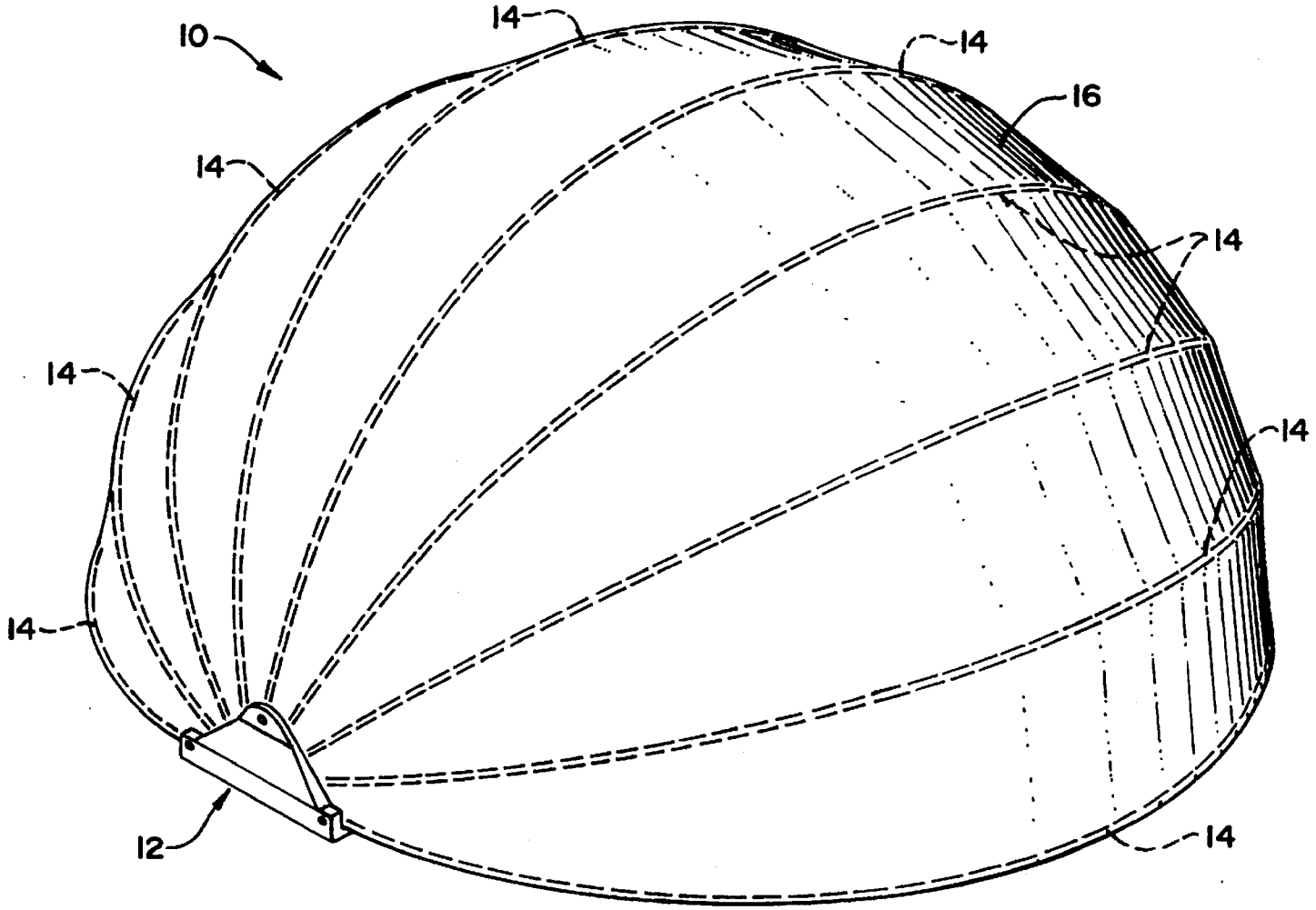
FIG. 1 is an isometric view of a dome shaped shelter in a closed condition.
Figure 2:
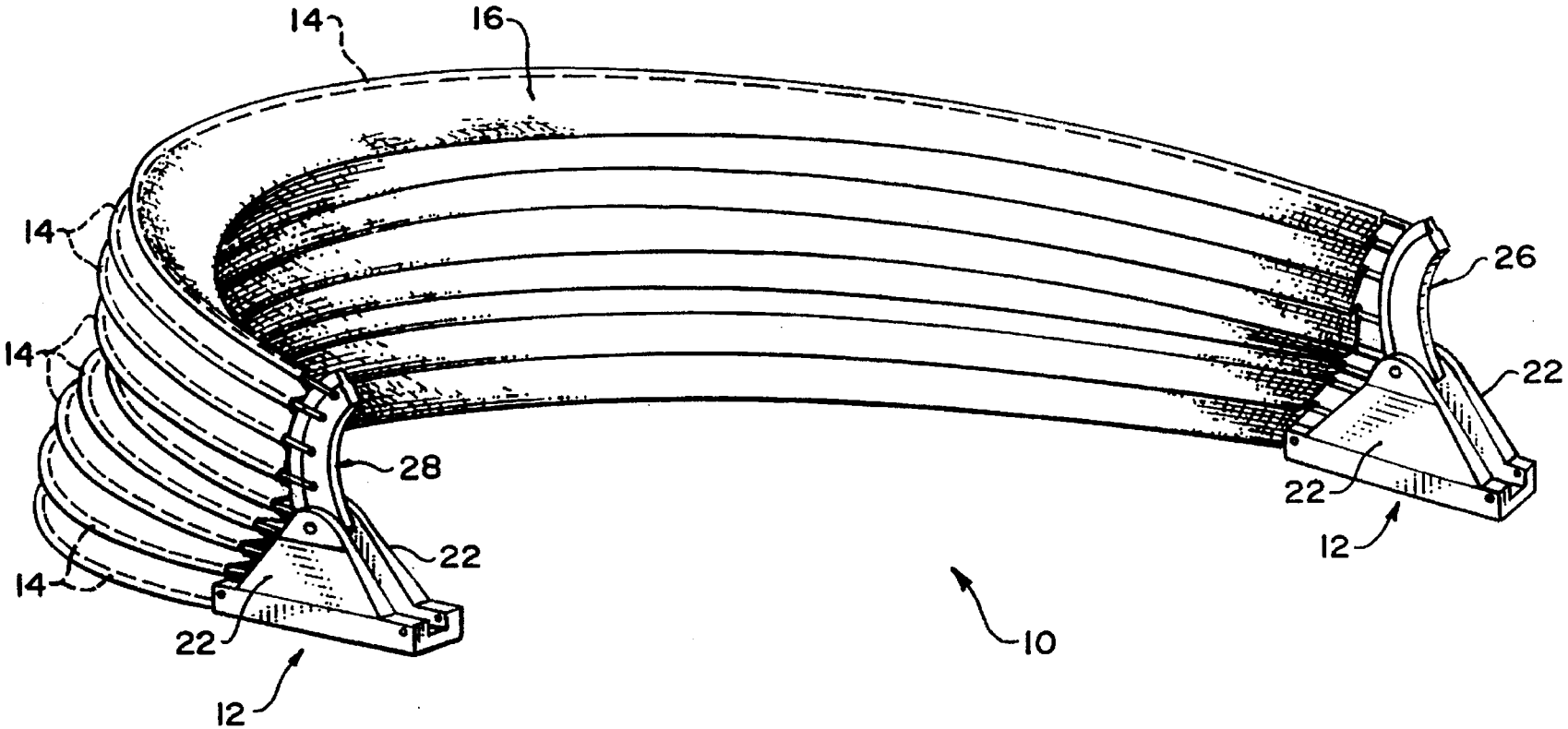
FIG. 2 is an isometric view of the shelter of FIG. 1 in an open condition.

Referring to the accompanying drawings, and especially to FIGS. 1 and 2, there is illustrated a shelter 10 of an overall dome-shape. The shelter has two hinge assemblies 12, one on either side of the shelter and a series of hoops 14 that have their opposite ends connected to the respective hinge assemblies and that radiate from the hinge assemblies at positions spaced through an arc of 180° in the extended or closed condition of FIG. 1. The hoops support a flexible canopy 16. The shelter 10 is shown in its open condition in FIG. 2, where one end of the shelter has been lifted up and pivoted over to the opposite end, and all of the hoops are stacked one on top of the other with the canopy material gathered much in the nature of an accordion fold.

The configuration of the hinge that permits this type of movement is illustrated most particularly in FIGS. 3 through 6. The hinge has a hinge base 18 with a bottom support surface 20. The base is generally channel shaped with two side flanges 22 that taper upwardly to the centre. Between the side flanges, and centred between the ends of the base is a semi cylindrical support core 24.

Figure 3:
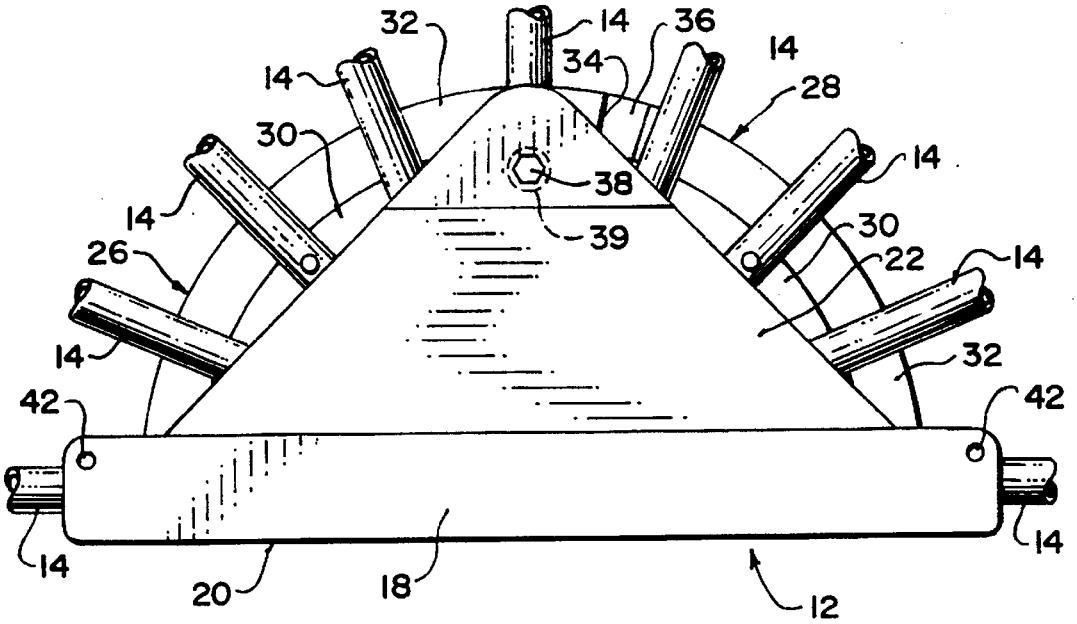
FIG. 3 is a side view of a hinge assembly.
Figure 4:
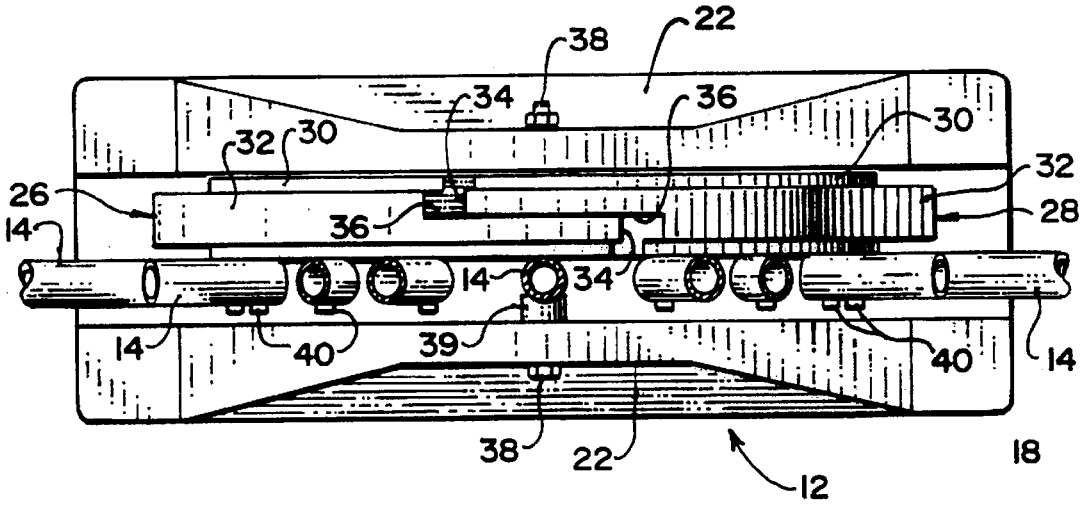
FIG. 4 is a top view of the hinge assembly.
Figure 5:
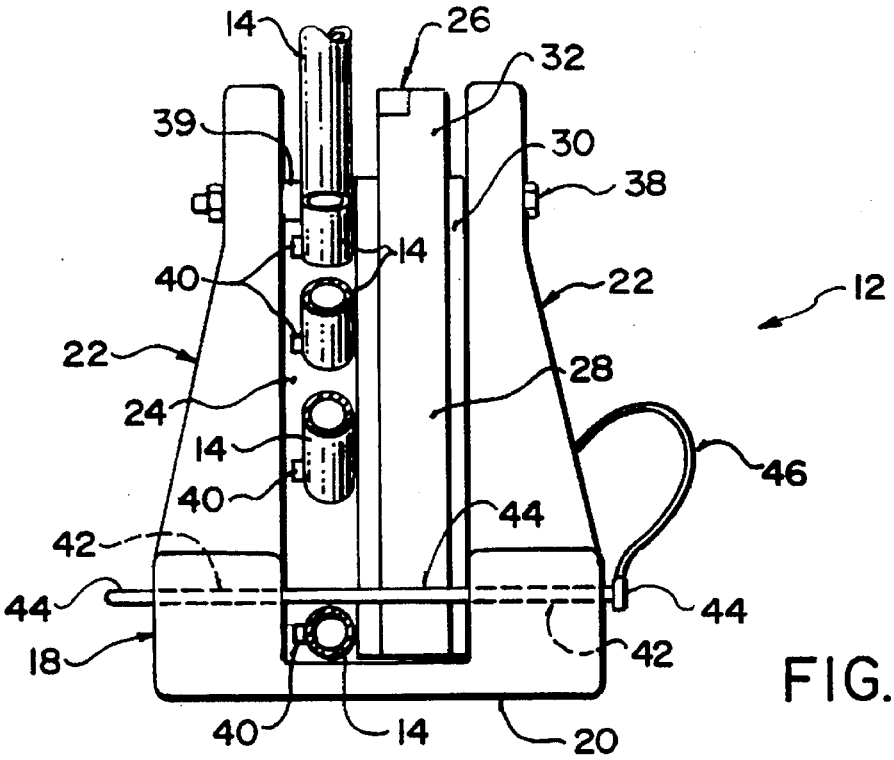
FIG. 5 is an end view of the hinge assembly.
Figure 6:
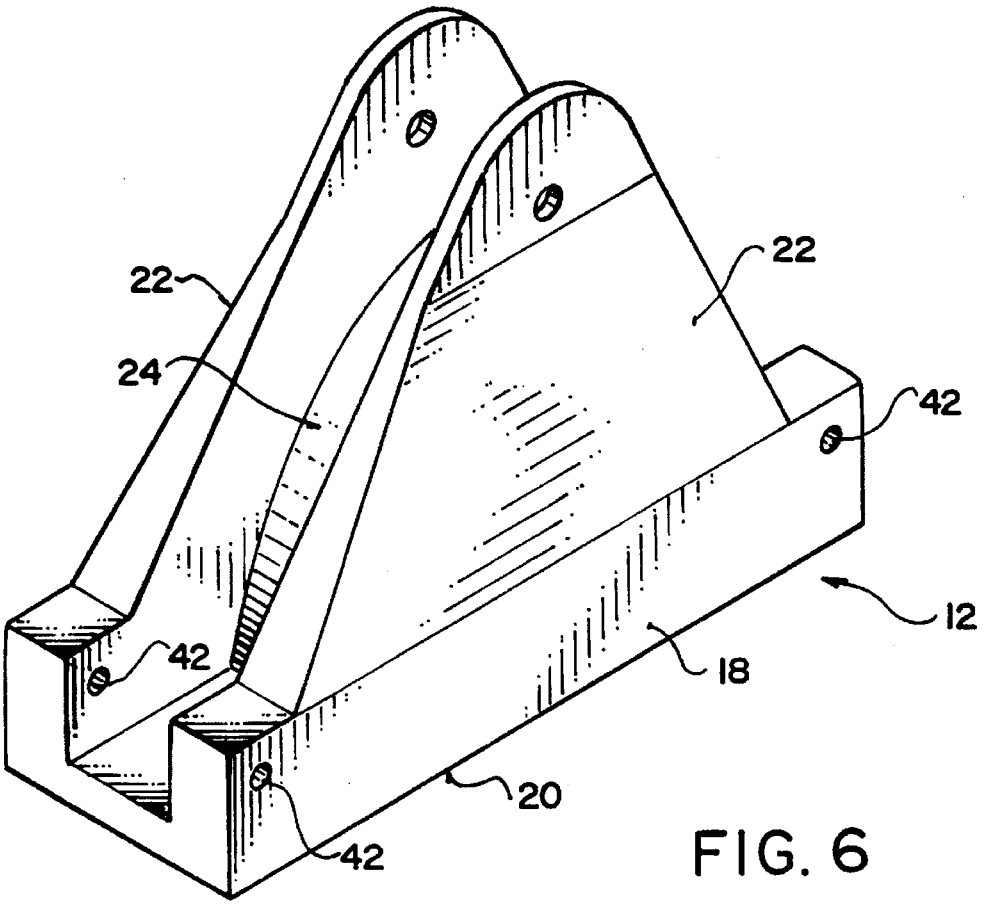
FIG. 6 is an isometric view of the hinge assembly base.

The hinge base carries two hinge arms 26 and 28. These are located in the centre of the base, between the side flanges 22. Each arm is in the shape of a circular arc with an inner section 30 and an outer section 32 of reduced thickness. The upper end 34 of the hinge arm is semi-circular in shape. Also at the upper end, each arm has a notch 36 on one side so that the two arms may be placed end to end with their notched ends interfitting as shown most particularly in FIG. 4. The arms are mounted on the base by a transverse pivot pin 38 extending through the arms where they overlap. In the extended condition of the shelter, the arms form a semi-circular arc, as shown in FIG. 3. A centre one of the hoops 14 has its end pivotally mounted on the pin 38, in the centre of the base. A spacer 39 is positioned between the hoop and the inside of the adjacent side flange 22. The arrangement is such that each arm and the hoop can pivot independently of the other components.

One half of the remaining hoops is pivotally mounted on each of the hinge arms 26 at spaced positions along the arm. They are held in place by pivot pins 40 extending through the hoops near their ends.

At each end of the hinge base are two aligned retainer bores 42 through the side flanges 22. These are positioned above the extended positions of the end most hoops 14, so that when a retainer pin 44 is inserted through the bores 42, the hoop will be retained in its extended position. Each retainer pin 44 is attached to the base with a tether 46.

When opening the shelter, it is a simple matter to raise one of the end most hoops 14. This will unbalance the canopy and hoop assembly, causing it to fall downwardly toward the opposite end, so that very little force is required to initiate this opening action. Once the opening has carried through to a sufficient extent, the imbalance towards the opening side may become sufficient to continue opening the shelter without assistance.

As the shelter opens, those hoops 14 on the closed end of the shelter will pivot downwardly about their pivot pins 40 to lie on one another as shown most particularly in FIG. 2. As the remaining hoops on the other side of the shelter reach a position where they will come into engagement with the centre hoop, the hinge arm on which they are mounted will pivot upwardly as shown in FIG. 2 until the two hinge arms are generally aligned with the hoop pivots spaced along the two arms so that there is no interference of one hoop with the other and the hoops will be stacked.

Figure 7:
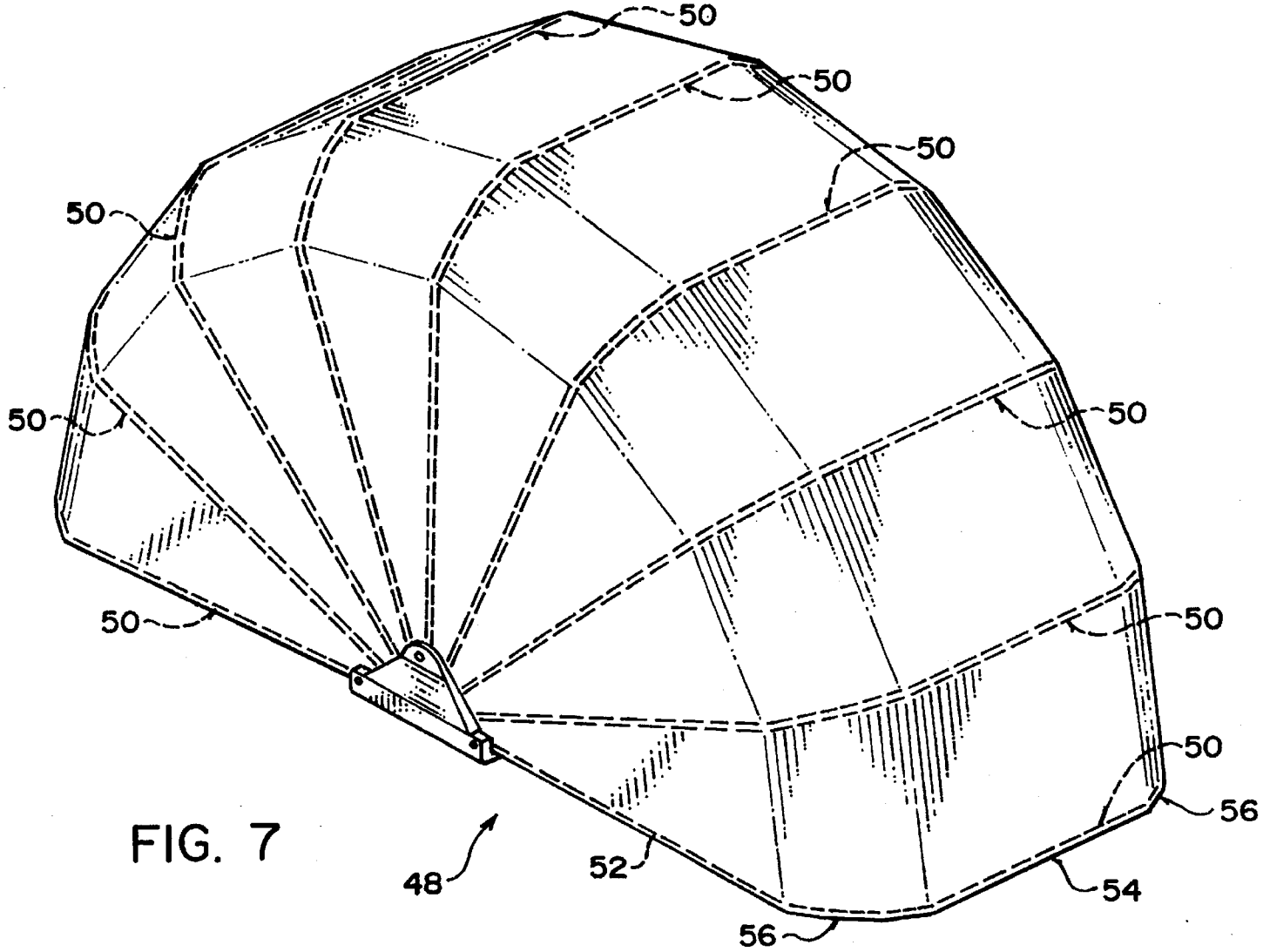
FIG. 7 is an isometric view of an alternative embodiment of the shelter.

Another embodiment of the shelter is illustrated in FIG. 7. This shelter 48 is more rectangular in its form and is somewhat higher and more elongate than the dome shelter shown in FIGS. 1 and 2. Each hoop 50 of the shelter 48 has two straight side sections 52, a straight centre section 54 and two straight corners 56. Apart from this difference in hoop configuration and the consequent difference in the configuration of the canopy, the shelter is functionally the same as that illustrated in the earlier drawings.

While particular embodiments of the present invention have been described in the foregoing, it is to be understood that other embodiments are possible within the scope of the invention. For example, various modifications may be made to the exact configuration of the hinge. The hinge arms need not be circular arcs, and in some embodiments, they may be mounted on separate arm axes. The invention is thus to be construed as limited solely by the scope of the dependent claims.

We claim:

1. A hinge assembly connecting a plurality of members for movement between an extended condition with the members radiating at spaced positions along an arc of substantially 180° about the hinge assembly and a collapsed condition with the members stacked adjacent the hinge assembly, said hinge assembly comprising:

a base;

two hinge arms;

arm pivot means pivotally mounting each of the hinge arms on the base for pivotal movement of the hinge arm with respect to the base about a lateral hinge arm axis; and means pivotally mounting the members on the hinge arms at spaced locations therealong, for pivotal movement of the members about respective lateral member axes with respect to the associated hinge arms.

2. A hinge according to claim 1 including stop means for limiting pivotal movement of the hinge arms.

3. A hinge according to claim 2 wherein the stop means comprise interengaging faces on the hinge arms.

4. A hinge according to claim 3 wherein the arm pivot means comprise means mounting the hinge arms on the base to pivot about a common lateral arm axis.

5. A hinge according to any one of claims 1 to 4 wherein the base has a support surface, the arm pivot means are spaced from the support surface and in the extended condition each hinge arm extends from the arm pivot means towards the support surface.

6. A hinge according to claim 5 wherein in the extended condition the hinge arms diverge from the arm pivot means towards the support surface.

7. A hinge according to claim 5 wherein the hinge arms are arcuate and in the extended condition of the hinge define a substantially semi-circular arc.

8. A shelter having two laterally spaced sides and two longitudinally spaced ends, the shelter comprising two laterally spaced apart hinge assemblies; a plurality of laterally extending hoops coupled to the hinge assemblies for movement between an extended condition of the shelter with the hoops radiating from the hinge assemblies at positions spaced angularly through an arc of approximately 180° about the hinge assemblies, and a collapsed condition with the hoops stacked to one end of the hinge assemblies; and a canopy connected to the hoops to be supported thereby in the extended condition of the shelter, wherein each hinge assembly comprises;

a base;

first and second hinge arms;

arm pivot means pivotally mounting each of the hinge arms on the base for pivotal movement of the hinge arm with respect to the base about a lateral arm axis, each hinge arm being pivotable between a closed condition extending downwardly from the lateral arm axis and an open position projecting upwardly from the lateral arm axis, each hoop being pivotally mounted on a respective hinge arm of each hinge assembly for pivotal movement about a respective lateral hoop axis.

9. A shelter according to claim 8 wherein each hinge assembly includes stop means for limiting pivotal movement of each hinge arm about the lateral arm axis to movement between the open and closed positions.

10. A shelter according to claim 9 wherein the stop means comprise interengaging faces on the hinge arms.

11. A shelter according to claim 8 wherein the base comprises a retainer means for selectively retaining an end most one of the hoops in the extended position thereof.

12. A shelter having two laterally spaced sides and two longitudinally spaced ends, the shelter comprising two laterally spaced apart hinge assemblies; a plurality of laterally extending hoops coupled to the hinge assemblies for movement between an extended condition of the shelter with the hoops radiating from the hinge assemblies at positions spaced angularly through an arc of approximately 180° about the hinge assemblies, and a collapsed condition with the hoops stacked to one end of the hinge assemblies; and a canopy connected to the hoops to be supported thereby in the extended condition of the shelter, wherein each hinge assembly comprises;

a base;

first and second hinge arms mounted pivotally on the base to pivot about a common lateral arm axis, each hinge arm being pivotable between a closed condition extending downwardly from the lateral arm axis and an open position projecting upwardly from the lateral arm axis, each hoop being pivotally mounted on a respective hinge arm of each hinge assembly for pivotal movement about a respective lateral hoop axis.

13. A shelter according to claim 12 wherein in the closed condition of the canopy, the hinge arms extend downwardly and towards the respective ends of the shelter from the lateral arm axis.

14. A shelter according to claim 13 wherein each hinge arms are arcuate, the arms aligning to define a substantially semi-circular arc in the extended condition of the canopy.

* * * * *